US010458198B2

(12) United States Patent
Garner et al.

(10) Patent No.: US 10,458,198 B2
(45) Date of Patent: Oct. 29, 2019

(54) TEST DART SYSTEM AND METHOD

(71) Applicant: GE Oil & Gas Pressure Control LP, Houston, TX (US)

(72) Inventors: Detrick Deyon Garner, Houston, TX (US); Alfred Olvera, Houston, TX (US); Eugene Borak, Houston, TX (US); Jason Armistead, Houston, TX (US); Samuel Cheng, Houston, TX (US); John Warner, Houston, TX (US); Nathan Burcham, Houston, TX (US)

(73) Assignee: GE Oil & Gas Pressure Control LP, Houston, TX (US)

( * ) Notice: Subject to any disclaimer, the term of this patent is extended or adjusted under 35 U.S.C. 154(b) by 0 days.

(21) Appl. No.: 15/670,717

(22) Filed: Aug. 7, 2017

(65) Prior Publication Data

US 2019/0040709 A1 Feb. 7, 2019

(51) Int. Cl.

| | |
|---|---|
| ***E21B 33/12*** | (2006.01) |
| ***E21B 33/124*** | (2006.01) |
| ***E21B 49/08*** | (2006.01) |
| ***E21B 34/10*** | (2006.01) |
| ***E21B 23/06*** | (2006.01) |

(Continued)

(52) U.S. Cl.

CPC ..... *E21B 33/1212* (2013.01); *E21B 33/124* (2013.01); *E21B 33/1208* (2013.01); *E21B 34/105* (2013.01); *E21B 49/081* (2013.01); *E21B 23/065* (2013.01);

(Continued)

(58) Field of Classification Search

CPC ..... E21B 34/02; E21B 34/00; E21B 21/10; E21B 49/081; E21B 33/124; E21B 33/1294

See application file for complete search history.

(56) References Cited

U.S. PATENT DOCUMENTS 1,673,419 A * 6/1928 Neitzel ..... E21B 49/081 166/151
4,460,039 A * 7/1984 Knight ..... E21B 34/02 166/379

(Continued)

FOREIGN PATENT DOCUMENTS

WO 2014070418 5/2014

OTHER PUBLICATIONS

International Search and Written Opinion dated Mar. 4, 2019 in related PCT Application No. PCT/US2018/054184.

*Primary Examiner* — James G Sayre
(74) *Attorney, Agent, or Firm* — Hogan Lovells US LLP

(57) ABSTRACT

Embodiments of the present disclosure include a test dart for wellbore pressure isolation. The test dart includes a body extending from a first end to a second end, the body having a bore extending therethrough, a diameter of the bore being greater at a first end than the second end. The test dart also includes a groove formed proximate the first end and extending radially outward from the bore and into the body. Additionally, the test dart includes an anti-rotation pin positioned between the groove and the second end, the anti-rotation pin extending radially outward from the body. The test dart further includes a check valve positioned in the bore, the check valve enabling flow in a single direction and being moveable between an open position to enable the flow and a closed position to block the flow.

18 Claims, 10 Drawing Sheets

(51) Int. Cl.
*E21B 33/129* (2006.01)
*E21B 43/116* (2006.01)
*E21B 47/10* (2012.01)

(52) U.S. Cl.
CPC ..... *E21B 33/1294* (2013.01); *E21B 43/116* (2013.01); *E21B 47/1025* (2013.01)

(56) References Cited

U.S. PATENT DOCUMENTS 5,148,828 A * 9/1992 Farnham ..... E03C 1/106 137/454.6
5,320,181 A * 6/1994 Lantier, Sr. ..... E21B 21/10 166/325
5,782,297 A * 7/1998 Samuels ..... E21B 31/20 166/237
5,941,311 A 8/1999 Newton
7,604,050 B2 10/2009 Dallas et al.
8,539,976 B1 * 9/2013 Rodgers, Jr. ..... F16K 15/066 137/512
9,297,226 B2 3/2016 Nguyen et al.
9,422,788 B2 * 8/2016 Nguyen ..... E21B 23/01
2010/0258319 A1 * 10/2010 Nguyen ..... E21B 23/02 166/373
2011/0011575 A1 1/2011 Nguyen
2012/0024521 A1 2/2012 Villa
2014/0202713 A1 * 7/2014 Stewart ..... E21B 34/14 166/386
2014/0367599 A1 * 12/2014 Dennis ..... F16K 31/52425 251/251
2016/0186527 A1 * 6/2016 Cocker, III ..... E21B 34/02 166/379
2016/0312576 A1 10/2016 Rogers
2017/0009555 A1 * 1/2017 Nguyen ..... E21B 23/00
2018/0258731 A1 * 9/2018 Budde ..... E21B 33/12

* cited by examiner

TEST DART SYSTEM AND METHOD

BACKGROUND

1. Field of Invention

This disclosure relates in general to oil and gas tools, and in particular, to systems and methods for installation of isolation components in a wellbore.

2. Description of the Prior Art

In oil and gas production, components are pressure tested at various stages of drilling, stimulation, completion, and recovery. During testing, various portions of a wellbore may be isolated utilizing valves, packing, or the like. In certain situations, it is desirable to test uphole and surface components. As such, downhole portions of the wellbore may be isolated. Often, isolating downhole components utilizes multiple trips into and out of the well to install and subsequently remove components. These trips lead to rig downtime and can be costly. Moreover, safety regulations may necessitate fully controlled wellbore environments during installation of testing components, further increasing costs. It is now recognized that improved methods for isolation and testing of wellbore components are desirable.

SUMMARY

Applicants recognized the problems noted above herein and conceived and developed embodiments of systems and methods, according to the present disclosure, for wellbore pressure isolation.

In an embodiment a test dart for wellbore pressure isolation includes a body extending from a first end to a second end, the body having a bore extending therethrough, a diameter of the bore being greater at a first end than the second end. The test dart also includes a groove formed proximate the first end and extending radially outward from the bore and into the body. Additionally, the test dart includes an anti-rotation pin positioned between the groove and the second end, the anti-rotation pin extending radially outward from the body. The test dart further includes a check valve positioned in the bore, the check valve enabling flow in a single direction and being moveable between an open position to enable the flow and a closed position to block the flow.

In another embodiment a system for isolating regions of a wellbore includes a unidirectional valve positioned in the wellbore, the unidirectional valve permitting a fluid flow in a downstream direction into the wellbore and restricting fluid flow in an upstream direction out of the wellbore. The system also includes a test dart non-rotationally coupled to the unidirectional valve, the test dart arranged upstream of the unidirectional valve and positioned to block the fluid flow in the downstream direction toward the unidirectional valve.

In an embodiment a method for isolating a wellbore includes lowering a test dart into the wellbore, the test dart being coupled to an installation tool. The method also includes coupling the test dart to a unidirectional valve arranged in the wellbore. The method further includes decoupling the installation tool from the test dart.

BRIEF DESCRIPTION OF THE DRAWINGS

The present technology will be better understood on reading the following detailed description of non-limiting embodiments thereof, and on examining the accompanying drawings, in which.

DETAILED DESCRIPTION OF THE INVENTION

Figure 1:
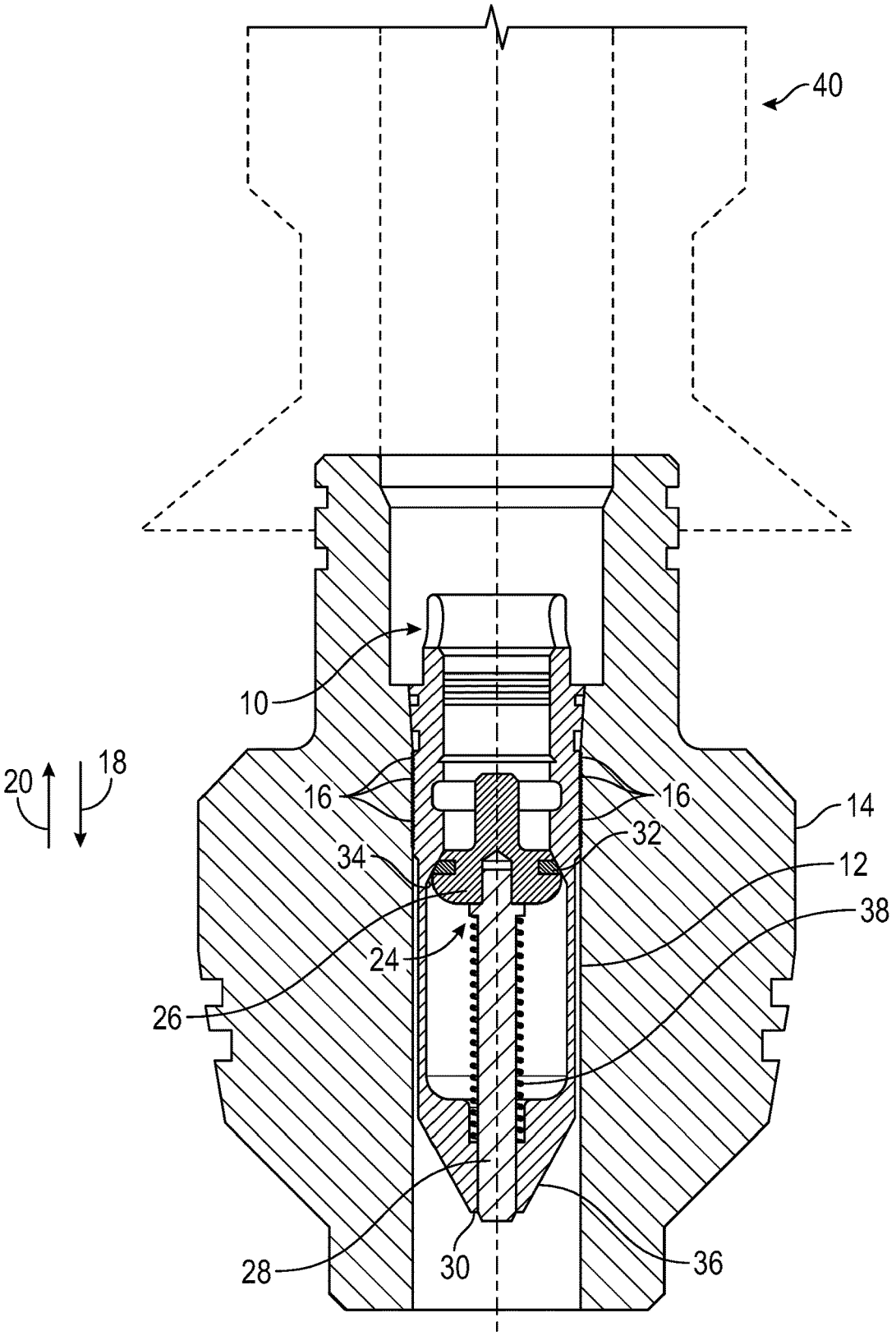
FIG. 1 is a schematic side view of an embodiment of a unidirectional valve arranged within a hanger, in accordance with embodiments of the present disclosure.

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present invention are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations.

Embodiments of the present disclosure are directed to systems and methods for isolating regions of a wellbore. In certain embodiments, a unidirectional valve is arranged within a wellbore, for example, coupled to a hanger. During operation, certain portions of the wellbore, such as the area above the unidirectional valve, may be independently pressure tested. A test dart may be installed in the wellbore to couple to the unidirectional valve to facilitate the testing. In embodiments, the test dart may be installed in an open or non-controlled wellbore to thereby reduce costs and the time for installation. For example, the test dart may be installed into the wellbore and couple to the unidirectional valve via the gravitational force acting on the test dart. In certain embodiments, the test dart may include one or more anti-rotation pins to substantially reduce the likelihood that rotational forces applied to the test dart may be transmitted to the unidirectional valve, potentially unseating the unidirectional valve from the hanger. Additionally, the running threads of the test dart may be in a direction substantially opposite the running threads of the unidirectional valve. As such, rotation applied to the test dart may not be transmitted to the unidirectional valve. The test dart may also include a lock out pin to block access to one or more threaded components in the test dart, thereby further reducing the likelihood of transmitting rotational forces to the unidirectional valve. In operation, the test dart may be installed and seated on the unidirectional valve. During recovery, a removal tool may be installed into the wellbore and non-rotationally couple to the test dart, for example via spring-loaded pins. As a result, the test dart may be removed utilizing a pulling, non-rotational force to thereby reducing the likelihood of unseating the unidirectional valve. In embodiments, installation and removal are both done in a non-controlled wellbore, thereby reducing the time for installation and reducing costs.

FIG. 1 is a schematic side view of an embodiment of a unidirectional valve 10 (e.g., back pressure valve (BPV), check valve, one-way valve, etc.) positioned within a bore 12 of a tubing hanger 14. In certain embodiments, the unidirectional valve 10 includes threads 16 to facilitate coupling to the tubing hanger 14. For instance, the tubing hanger 14 may include corresponding threads for installation of the unidirectional valve 10. In operation, the unidirectional valve 10 will allow flow into a wellbore in a single direction and block flow in the opposite direction. For example, the illustrated unidirectional valve 10 enables flow in a downstream direction 18 and blocks flow in an upstream direction 20. As used here, the downstream direction 18 is the direction of flow into the wellbore and the upstream direction 20 is the direction of flow out of the wellbore.

The illustrated unidirectional valve 10 has a poppet valve 24 that may include a flange 26 and an elongate member 28 that extends from the flange 26 to or near a bottom end 30 of the unidirectional valve 10. The flange 26 may have a seal 32 that blocks fluid from passing between the flange 26 and a shoulder 34 on a body 36 of the unidirectional valve 10. In the illustrated embodiment, a spring 38 surrounds at least a portion of the elongate member 28 to help control the movement of the poppet valve 24. In operation, as fluid flows in the downstream direction 18, the spring 38 is compressed and the flange 26 is driven away from the shoulder 34 to enable fluid flow past the elongate member 28 and through the bore 12. The spring 38 is biased so that absent the external force, for example from a fluid flow, the flange 26 is driven against the shoulder 34. It should be appreciated that while the illustrated unidirectional valve 10 includes the poppet valve 24, in other embodiments the unidirectional valve 10 may be a ball check valve, a spring check valve, diaphragm check valve, a swing check valve, a stop check valve, a lift check valve, or any other reasonable device that enables flow in a direction and blocks flow in an opposite direction.

During oil and gas operations, different portions of the wellbore may be isolated in order to conduct pressure testing to evaluate potential leakage points. For example, a wellhead assembly 40 which may include a tree, blow out preventer (BOP) or the like arranged uphole from the unidirectional valve 10. Prior to operations, such as completion or production operations, the components of the wellhead assembly 40 may be pressure tested independently of the remainder of the wellbore. As will be described in detail below, embodiments of the present disclosure include the unidirectional valve 10 configured to receive a test dart that may be installed in a non-controlled environment (e.g., without a lubricator, in an open hole environment, at substantially atmospheric pressure, etc.) to enable faster and more cost-effective installation and removal of the test dart. In other words, a primary pressure barrier (e.g., the unidirectional valve) is not removed from the wellbore during downhole operations and therefore at least one pressure controlling device remains in position to control pressure from the wellbore. Furthermore, in embodiments, the test dart may include one or more features to block rotation and thereby enable installation and removal using pushing and pulling forces, thereby reducing the likelihood of unseating the unidirectional valve 10 from the hanger 14.

Figure 2:
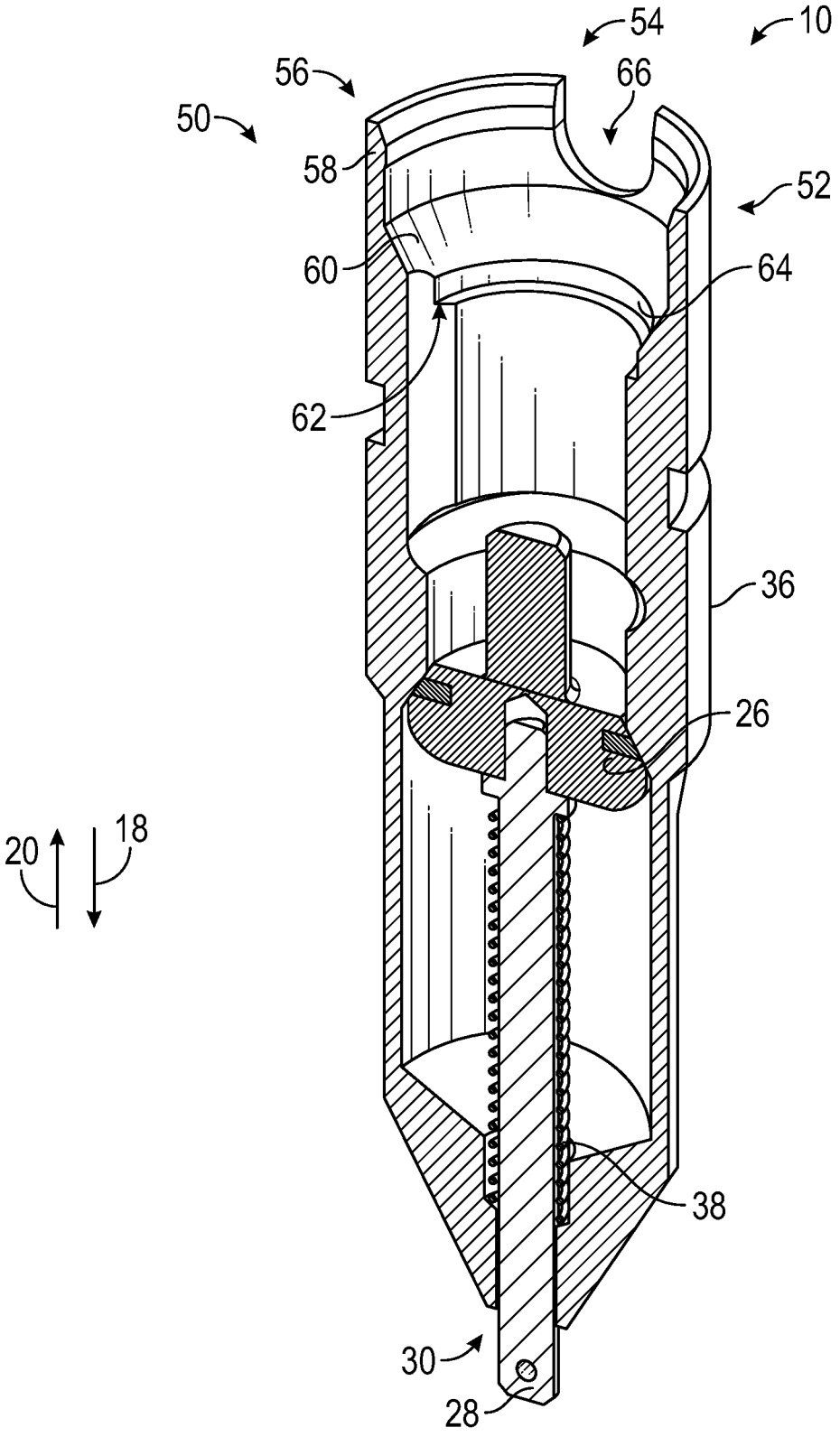
FIG. 2 is a cross-sectional isometric view of an embodiment of a unidirectional valve, in accordance with embodiments of the present disclosure.

FIG. 2 is an isometric cross-sectional view of an embodiment of the unidirectional valve 10. It should be appreciated that certain features of the embodiment of the unidirectional valve 10 may be shared with the embodiment illustrated in FIG. 1. However, the embodiment illustrated in FIG. 2 may include one or more additional features as described herein that facilitate installation and removal of isolation components such as test darts via pushing and pulling forces to reduce and/or substantially eliminate rotational connections.

The illustrated unidirectional valve 10 includes the body 36 and the flange 26 coupled to the elongate member 28 extending substantially to the bottom end 30 of the unidirectional valve 10. In the illustrated embodiment, the elongate member 28 is at least partially surrounded by the spring 38 to bias the flange 26 in an upstream direction 20, thereby driving the unidirectional valve 10 into the illustrated closed position 50. When in the closed position 50, the flange 26 is arranged in contract with the shoulder 34. Moreover, the seal 32 is urged against the shoulder 34 thereby blocking fluid from flowing in the upstream direction 20.

The unidirectional valve 10 includes an upper portion 52 that at least partially forms a through bore 54 extending from a top end 56 to the bottom end 30. The top end 56 includes a lip 58 extending longitudinally downward and a load shoulder 60 extending radially inward from the lip 56. The load shoulder 60 has a downwardly sloped surface and is utilized to form a seal between a test dart and the unidirectional valve 10. As illustrated in FIG. 2, a counter bore 62 is formed proximate the load shoulder 60. The counter bore 62 is positioned to relieve pressure when the unidirectional valve 10 is installed in the wellbore. Additionally, as shown, a groove 64 is arranged proximate the counter bore 62. The groove 64, along with the lip 58, acts as a friction retention feature to facilitate coupling of the test dart to the unidirectional valve 10. For instance, one or more anti-rotation pins (not pictured) and an o-ring may be arranged within the groove 64. In certain embodiments, the o-ring is arranged in the groove 64, but for clarity, has been omitted to illustrate the groove 64. The lip 58 also includes a u-slot 66. The u-slot 66 extends radially downward into the lip 58 and receives anti-rotation pins coupled to the test dart, as will be described below. In certain embodiments, the upper portion 52 is an elongated portion that facilitates coupling of the test dart and also enables connection of standard fixed and/or floating thread run and recovery tools. In other words, the unidirectional valve 10 is designed to work with existing tools. It should be appreciated that certain areas of the through bore 54 and/or the counter bore 62 may include threaded fittings to facilitate coupling with other tools.

Figure 3:
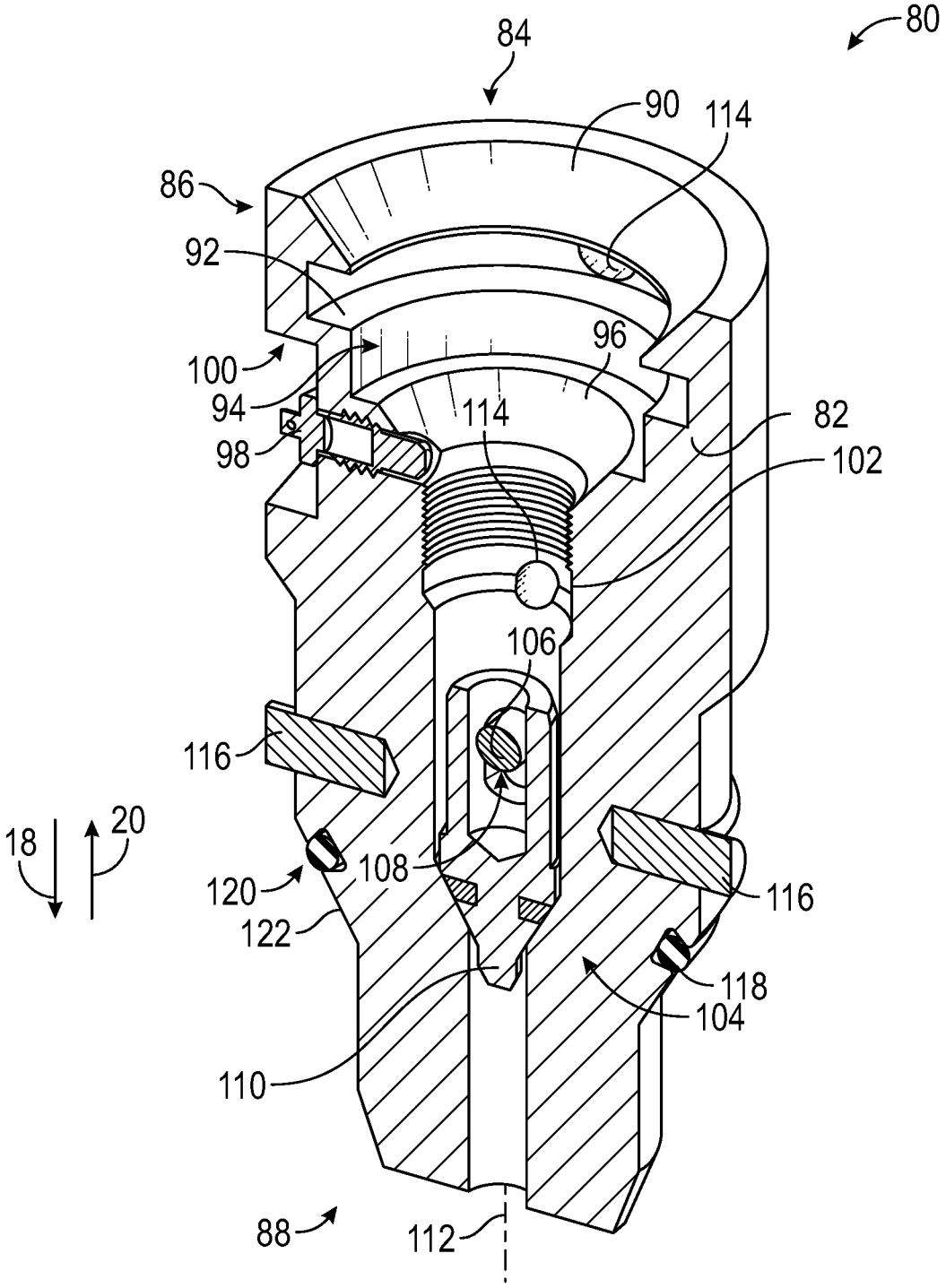
FIG. 3 is a cross-sectional isometric view of an embodiment of a test dart, in accordance with embodiments of the present disclosure.

FIG. 3 is an isometric cross-sectional view of an embodiment of a test dart 80. The test dart 80 is configured to couple to the unidirectional valve 10 to enable isolation of components upstream of the unidirectional valve 10 for pressure testing operations. As shown, the test dart 80 has an outer profile to substantially conform to at least a portion of the through bore 54 of the unidirectional valve 10. In the illustrated embodiment, the test date 80 includes a body 82 and a bore 84 extending from a first end 86 to a second end 88. As illustrated, the bore 84 has a variable diameter that decreases from the first end 86 to the second end 88. It should be appreciated that in other embodiments the bore 84 may have more or fewer transitions between diameters. The first end 86 includes a tapered shoulder 90 having a substantially downward slope extending toward the bore 84. Moreover, a radially outwardly positioned groove 92 is arranged downhole (e.g., toward the second end 88) from the tapered shoulder 90. As illustrated, the groove 92 has a larger outer diameter than the proximate bore 84 and is utilized to couple to a removal tool, as will be described below.

As shown in FIG. 3, the test dart 80 has a counter bore 94 with a slanted edge 96. A lock out pin 98 is arranged proximate the counter bore 94 and in the illustrated embodiment is substantially aligned with the slanted edge 96. The lock out pin 98 is utilized to block passage through the bore 84, for example via a tool, after the test dart 80 is arranged downhole in the wellbore. In certain embodiments, the lock out pin 98 is a spring loaded pin that extends through the body 82 and is accessible via a notch 100 formed in the body 82. As will be described below, the lock out pin 98 extends into the bore 84 and blocks tools, such as incompatible recovery tools, from accessing the threads 102 formed in the bore 84. For example, as will be described below, an installation tool may be threaded into the test dart 80 at the wellbore surface by pulling the lock out pin 98 to thereby enable insertion of the installation tool into the bore 84. However, upon removal of the installation tool, the lock out pin 98 is driven into the bore 84 to block subsequent installation of other tools.

The illustrated test dart 80 includes an internal check valve 104. As shown, the internal check valve 104 is secured to the test dart 80 via a rod 106. The check valve 104 includes an aperture 108 that enables a flange 110 to move axially along an axis 112. Movement of the check valve 104 is substantially blocked in the downstream direction 18 in the embodiment illustrated in FIG. 2, but enabled in the upstream direction 20. As shown, the bore 84 includes weep holes 114 to enable the passage of gas and or liquid to substantially block or reduce pressurizing the test dart 80. By eliminating internal pressures in the test dart 80, the likelihood the installation and retrieval tools are subjected to pressures is substantially reduced, thereby enabling installation and retrieval in non-controlled (e.g., open) wellbores, as opposed to controlled (pressurized) wellbores.

The test dart 80 illustrated in FIG. 3 includes anti-rotation pins 116 extending radially outward from the body 82. In certain embodiments, the anti-rotation pins 116 have a larger outer diameter than the body 82. In operation, the anti-rotation pins 116 align with the u-slot 66 of the unidirectional valve 10. As will be described below, the anti-rotation pins 116 block rotation of the test dart 80 relative to the unidirectional valve 10, thereby reducing or removing the likelihood of transmitting a rotational force to the unidirectional valve 10, which could unseat the unidirectional valve 10 from the hanger 14. In embodiments, the anti-rotation pins 116 work in conjunction with the direction of the test dart 80 running threads (e.g., threads 102) that enable a rotational force to be applied to the test dart 80 without transmission to the unidirectional valve 10 due to the direction of the threads 16. For instance, one set of threads may be right-handed while the other set of threads may be left-handed. In certain embodiments, the unidirectional valve 10 is made up to the hanger 14 by a left-handed rotation while the test dart 80 is made up to the running tool by a right-handed rotation. Therefore, when the anti-rotation pins 116 land in the u-slots 66, left-handed rotation of the running tool removes the running tool from the test dart 80. This left-handed rotation is the same direction as the unidirectional valve 10 and therefore tightens the unidirectional valve 10. The test dart 80 also includes a seal 118 arranged within a seal annulus 120. The seal 118 may be an elastomer seal (e.g., a polymer) that may flex or deform when external forces drive the seal 118 against sealing surface, which may be the load shoulder 60 of the unidirectional valve 10. In certain embodiments, external forces may be sufficient so as to drive the metallic body 82 against the load shoulder 60 of the unidirectional valve 10, thereby forming a metal to metal seal in the wellbore. As illustrated, the profile 122 of the body 82 may be particularly selected to substantially conform to the load shoulder 60.

Figure 4A:
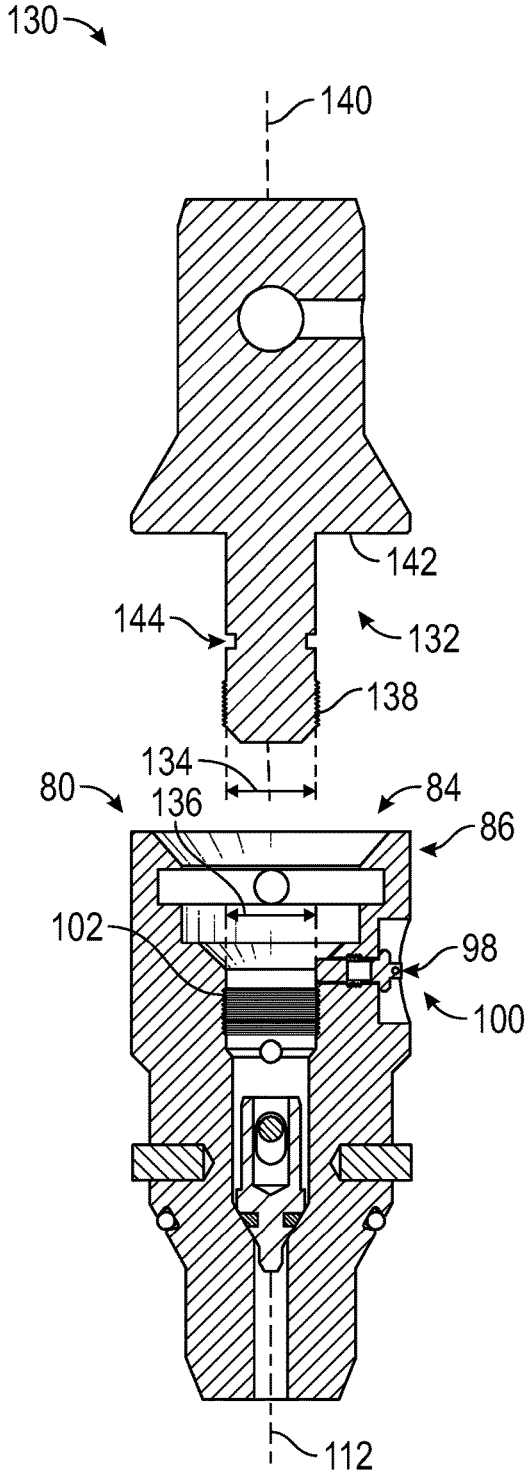
FIG. 4A is a schematic side view of an embodiment of an installation tool arranged proximate a test dart, in accordance with embodiments of the present disclosure.
Figure 4B:
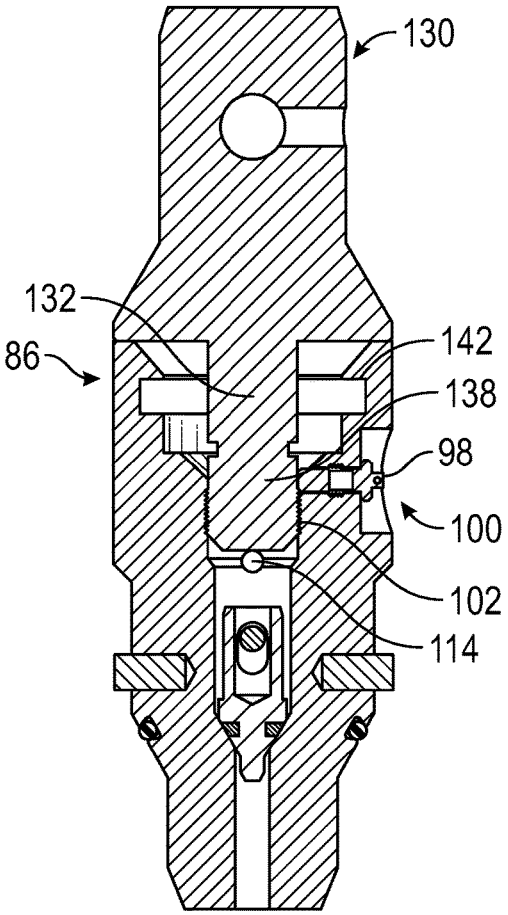
FIG. 4B is a schematic side view of an embodiment of the installation tool of FIG. 4A coupled to the test dart of FIG. 4A, in accordance with embodiments of the present disclosure.

FIG. 4 is a schematic side view of an embodiment of the test dart 80 coupling to an installation tool 130. FIG. 4A illustrates the installation tool 130 substantially aligned with the bore 84 of the test dart 80 and FIG. 4B illustrates the installation tool 130 coupled to the test dart 80. In the illustrated embodiment, the installation tool 130 includes a lower portion 132 having a diameter 134 substantially equal to diameter 136 of at least of a portion of the bore 84. This lower portion 132 further includes threads 138 that engage the threads 102 of the test dart 80. In the embodiment shown in FIG. 4A, an axis 140 of the installation tool 130 is substantially aligned with the axis 112 of the test dart 80, thereby enabling insertion of the lower portion 132 into the bore 84.

In certain embodiments, the installation tool 130 is coupled to the test dart 80 at the surface of the wellbore thereby enabling an operator to pull the lock out pin 98 out of the bore 84. The lock out pin 98 is accessible through the notch 100 when the test dart 80 is at the surface. Accordingly, the operator may clear the bore 84 for installation of the installation tool 130. Thereafter, the installation tool 130 can be lowered into the bore 84 and secured via the threads 102, 138. In the illustrated embodiment, a downward facing shoulder 142 of the installation tool 130 contacts the first end 86 of the test dart 80 when the installation tool 130 is fully installed. This may serve as an indicator to the operator that the threads 102, 138 are fully engaged. However, it should be appreciated that in other embodiments the installation tool 130 may not contact the first end 86 of the test dart 80.

In the illustrated embodiment, the installation tool 130 includes a groove 144, which may be a thread relief. As shown in FIG. 4B, after installation the lock out pin 98 bears against the lower portion 132 of the installation tool 130. In the illustrated embodiment, the lower portion 132 does not extend past the weep hole 114, thereby enabling pressurized fluid or gases to flow out of the bore 84.

FIG. 5 is a schematic side view of the test dart 80 being coupled to the unidirectional valve 10. FIGS. 5A-5D illustrate a series of steps to install the test dart 80, including lowering the test dart 80 into the unidirectional valve 10, engaging the anti-rotation pins 116, removing the installation tool 130 using a pulling force, and the test dart 80 coupling to the unidirectional valve 10. As shown in FIG. 5A, the axis 140 is substantially aligned with an axis 160 of the unidirectional valve 10, thereby aligning the test dart 80 with the unidirectional valve 10. In certain embodiments, the installation tool 130 may be a dry rod or rod that enables installation in a non-controlled environment. That is, the valves at the wellhead assembly 40 (e.g., on the tree or BOP) may be in an open position such that the components upstream of the unidirectional valve are at substantially atmospheric pressure. As a result, installation may be faster and less expensive than in a controlled environment (e.g., not at substantially atmospheric pressure). As described above, the installation tool 130 may be threaded into the test dart 80 at the surface for subsequent installation within the wellbore.

Figure 5A:
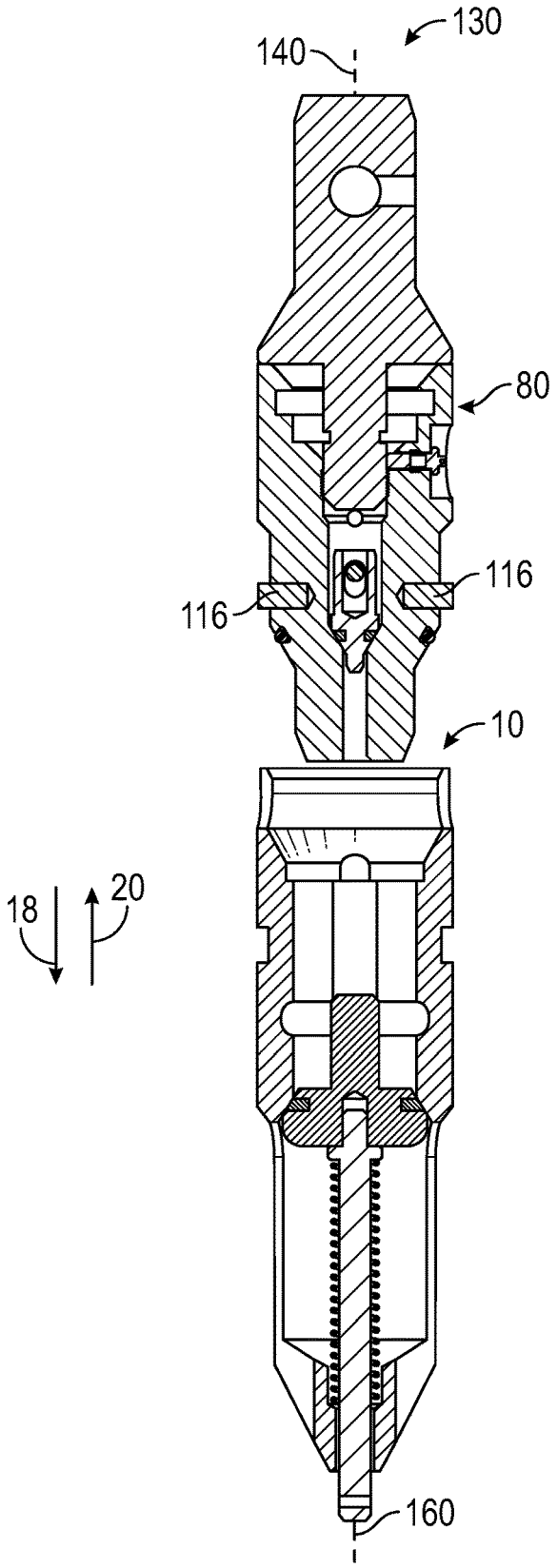
FIG. 5A is a schematic side view of an embodiment of a test dart arranged proximate a unidirectional valve, in accordance with embodiments of the present disclosure.
Figure 5B:
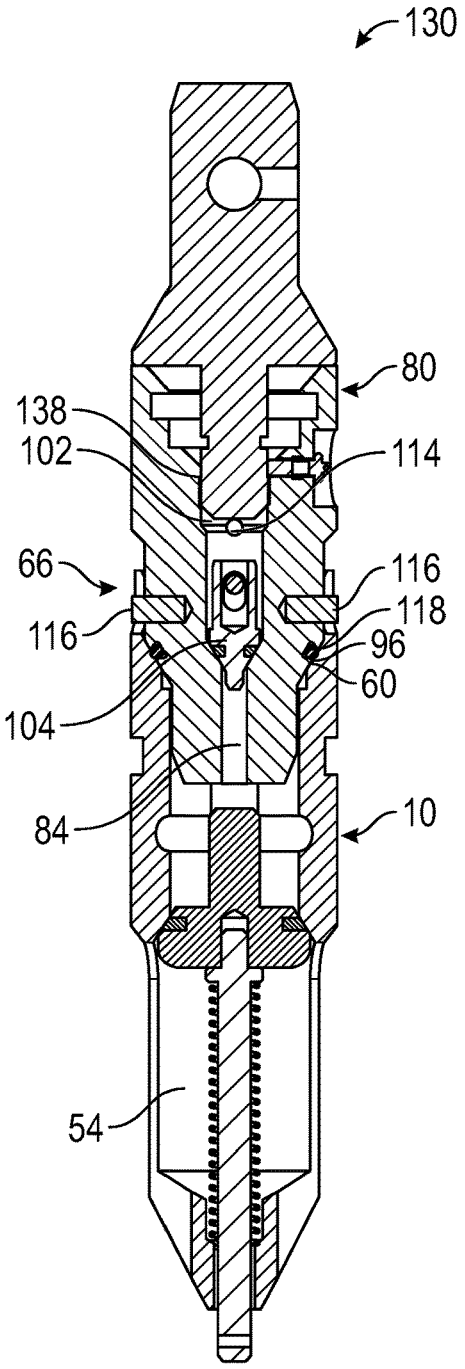
FIG. 5B is a schematic side view of an embodiment of the test dart of FIG. 5A coupled to the unidirectional valve of FIG. 5A, in accordance with embodiments of the present disclosure.

FIG. 5B illustrates the test dart 80 in contact with and installed on the unidirectional valve 10. As illustrated, the installation tool 130 drives the test dart 80 in the downstream direction 18 and into contact with the unidirectional valve 10. As shown, the slanted edge 96 of the test dart 80 bears against the load shoulder 60 of the unidirectional valve 10. In certain embodiments, the seal 118 is driven against the load shoulder 60 to restrict or substantially block flow from the through bore 54 of the unidirectional valve in the upstream direction 20. That is, for example, if the unidirectional valve 10 were leaking, pressurized fluids (e.g., gas, liquids, multi-phase flow, etc.) may flow past the flange 26 toward the test dart 80. The seal 118, and in certain embodiments the metal-to-metal contact between the load shoulder 60 and the slanted edge 96, directs the fluid toward the bore 84. In the bore 84, the check valve 104 may enable the fluid to flow upstream via the weep holes 114.

In the embodiment illustrated in FIG. 5B, the anti-rotation pins 116 are slotted into the u-slot 66 of the unidirectional valve 10, thereby blocking rotation of the test dart 80 relative to the unidirectional valve 10. In certain embodiments, the threads 102, 138 facilitating the connection between the installation tool 130 and the test dart 80 are arranged in a direction opposite the threads coupling the unidirectional valve 10 to the hanger 14 (e.g., right handed threading and left hand threading). As a result, rotational forces applied to the installation tool 130 to remove the installation tool 130, as shown in FIG. 5C, will not be transmitted to loosen the connection between the unidirectional valve 10 and the hanger 14.

Figure 5C:
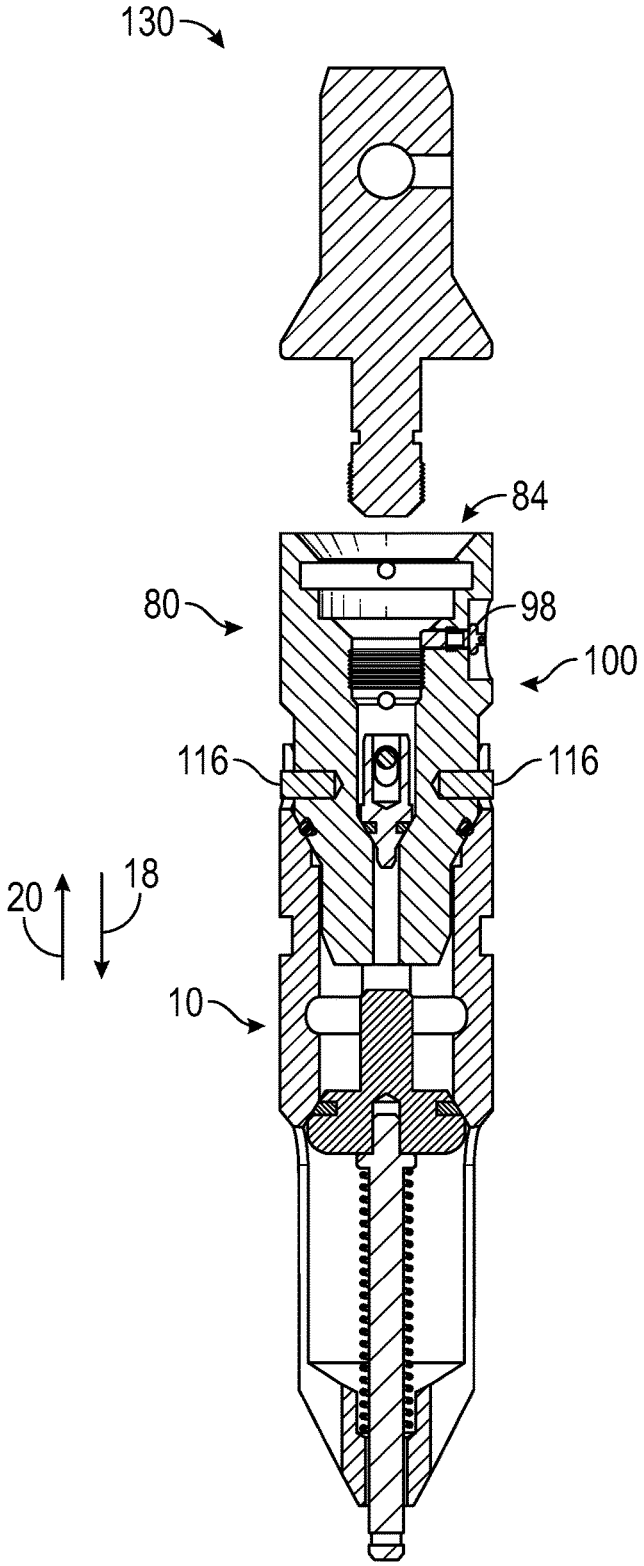
FIG. 5C is a schematic side view of an embodiment of the test dart of FIG. 5A coupled to the unidirectional valve of FIG. 5A, in accordance with embodiments of the present disclosure.

FIG. 5C illustrates the installation tool 130 being removed from the installed test dart 80. In the illustrated embodiment, the installation tool 130 is removed from the wellbore in the upstream direction 20 while leaving the test dart 80 arranged in contact with the unidirectional valve 10. The weight of test dart 80, along with pressurized fluids for performing testing of uphole equipment, enable the test dart 80 to maintain in position without utilizing a fixed connection to the unidirectional valve 10. However, it should be appreciated that the test dart 80 may include one or more connection members to couple the test dart 80 to the unidirectional valve 10. For example, the test dart 80 may include shear pins, clamps, and the like. As shown in FIG. 5C, as the installation tool 130 is removed the lock out pin 98 extends into the bore 84 to thereby block the installation of additional tools within the test dart 80. Moreover, because the test dart 80 is arranged downhole and the notch 100 is substantially blocked from activation from above or below, the lock out pin 98 is configured to remain in the bore 84 until removed from the wellbore.

Figure 5D:
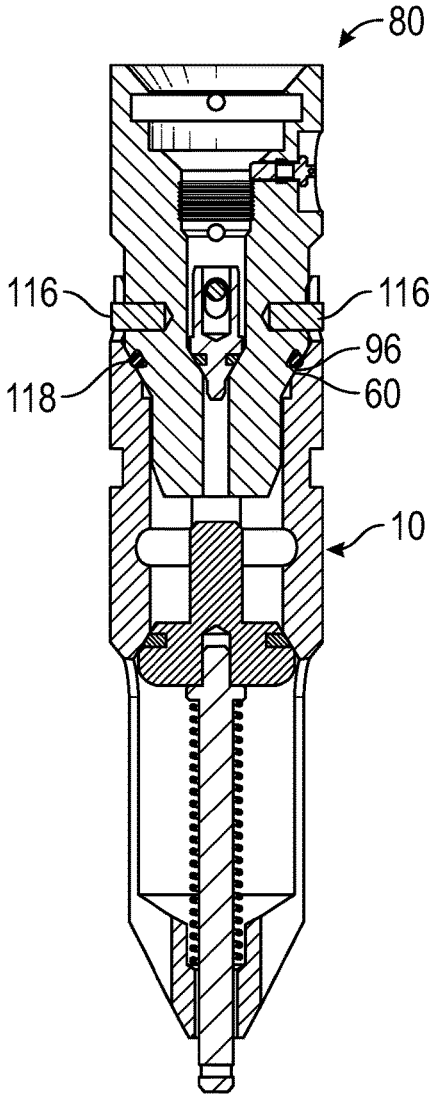
FIG. 5D is a schematic side view of an embodiment of the test dart of FIG. 5A coupled to the unidirectional valve of FIG. 5A, in accordance with embodiments of the present disclosure.

FIG. 5D illustrates the test dart 80 coupled to the unidirectional valve 10. As described above, the respective inclined surfaces of the test dart 80 and the unidirectional valve 10 are substantially aligned such that the seal 118 of the test dart 80 is positioned along the load shoulder 60. Furthermore, during pressurization situations a metal-to-metal seal may form between the test dart 80 and the unidirectional valve 10. For example, in certain embodiments, the upstream equipment may be tested to pressures of approximately 1.38×10^8 Pascals (e.g., approximately 20,000 psi). However, it should be appreciated that higher or lower pressurizes may be used. For example, the test pressures may be approximately 6.895×10^6 Pascals (e.g., approximately 1,000 psi); approximately 3.45×10^7 Pascals (approximately 5,000 psi); approximately 6.895×10^7 Pascals (approximately 10,000 psi), or any other reasonable pressure.

Figure 6:
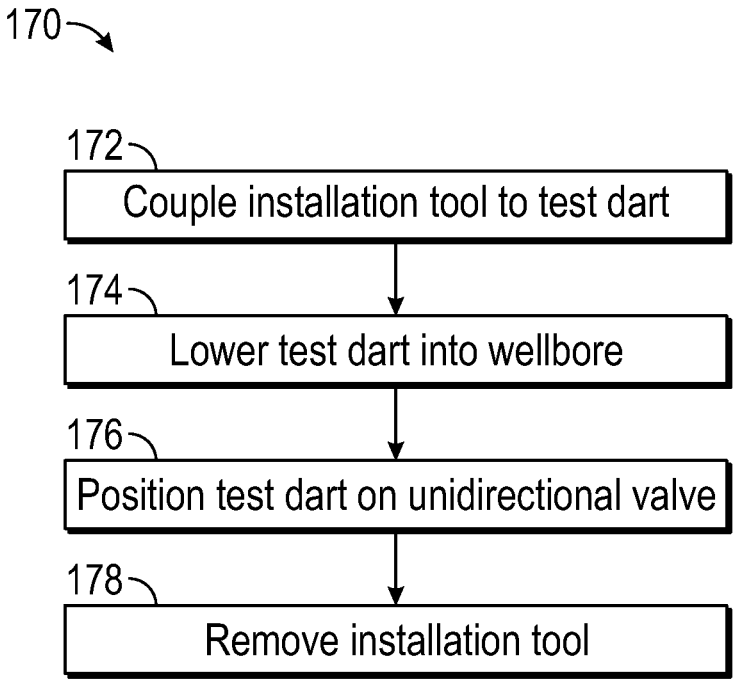
FIG. 6 is a flow chart of an embodiment of a method for installing a test dart into a wellbore, in accordance with embodiments of the present disclosure.

FIG. 6 is a flow chart of an embodiment of a method 170 for installing the test dart 80. As described above, in certain embodiments, the test dart 80 is utilized to perform pressure testing above the unidirectional valve 10 without installing a two-way check valve and also utilizing a non-controlled system to install the test dart 80. The installation tool 130 is coupled to the test dart 80 (block 172). For example, the installation tool 130 may be threaded to the test dart 80 via the threads 102, 138. During installation, the lock out pin 98 may be drawn radially outward away from the bore 84 to enable installation of the lower portion 132 of the installation tool 130 into the bore 84 of the test dart 80. Thereafter, the test dart 80 is lowered into the wellbore (block 174). In certain embodiments, the step described in block 174 is done via a dry rod in a non-controlled (e.g., not pressure sealed) environment. That is, the valves on the wellhead assembly 40 may be in an open position and substantially at atmospheric pressure. As a result, the test dart 80 may be lowered into the wellbore faster and cheaper. It should be appreciated that in certain embodiments the step shown at block 174 may be done in a controlled environment, for example, using a lubricator. Next, the test dart 80 is positioned on the unidirectional valve 10 (block 176). In the illustrated embodiment, test dart 80 is substantially aligned with the unidirectional valve 10 such that the axis 160 of the unidirectional valve 10 is substantially coaxial with the axis 112 of the test dart 80. When the test dart 80 is positioned on the unidirectional valve 10, the load shoulder 60 receives the slanted edge 96 to thereby form a seal between the test dart 80 and the unidirectional valve 10. For example, the seal 118 may be compressed to block fluid from moving through the throughout 54 or a metal-to-metal seal may be formed between the test dart 80 and the unidirectional valve 10. Additionally, in certain embodiments, the anti-rotation pins 116 of the test dart 80 are aligned with the u-slots 66 to thereby block transmission of rotation from the test dart 80 to the unidirectional valve 10. Thereafter, the installation tool 130 is removed (block 178). For example, in certain embodiments the installation tool 130 is threaded to the test dart 80. The installation tool 130 may be unthreaded from the test dart 80 before removal. In certain embodiments, the threads that couple the installation tool 130 to the test dart 80 are opposed to the threads coupling the hanger 14 and unidirectional valve 10. For example, the threading between the installation tool 130 and the test dart 80 may be left handed and the threading between the hanger 14 and the unidirectional valve 10 may be right handed. Accordingly, rotation is not transmitted from the test dart 80 to the unidirectional valve 10, thereby reducing the likelihood of unseating the unidirectional valve 10. In this manner, the test dart 80 may be installed in the wellbore.

FIG. 7 is a schematic side view of the test dart 80 being removed from the wellbore. FIGS. 7A-7D illustrate a series of steps to remove the test dart 80, including lowering a removal tool 190 into the wellbore, engaging the test dart 80, and removing the test dart 80 using a pulling force to thereby reduce the likelihood of unseating the unidirectional valve 10 from the hanger 14. FIG. 7A illustrates the test dart 80 arranged in contact with the unidirectional valve 10 in the wellbore. As described above, the anti-rotation pins 116 (not pictured) block rotation of the test dart 80 relative to the unidirectional valve 10 and the load shoulder 60 receives the slanted edge 96. FIG. 7B illustrates the removal tool 190 being lowered into the wellbore toward the test dart 80. The illustrated removal tool 190 includes plungers 192 that are spring biased to extend radially outward from an axis 194 of the removal tool 190. As the removal tool 190 is lowered into contact with the test dart 80, the plungers 192 are driven radially inward to enable passage of the removal tool 190 toward the bore 84. In certain embodiments, the first end 86 of the test dart 80 includes a taper 196 to facilitate driving the plungers 192 radially inward.

Figure 7A:
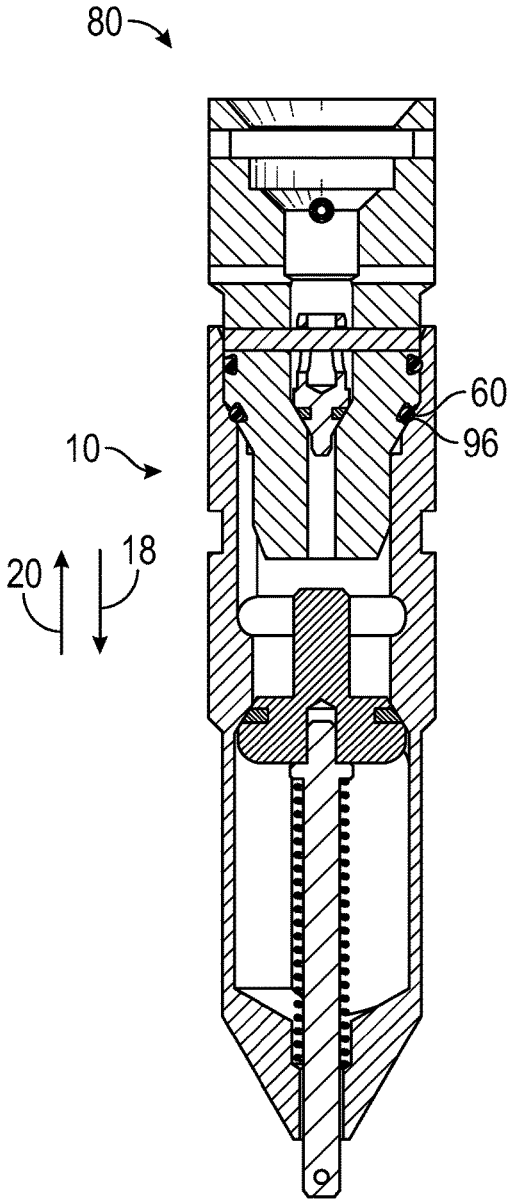
FIG. 7A is a schematic side view of an embodiment of a test dart coupled to a unidirectional valve, in accordance with embodiments of the present disclosure.
Figure 7B:
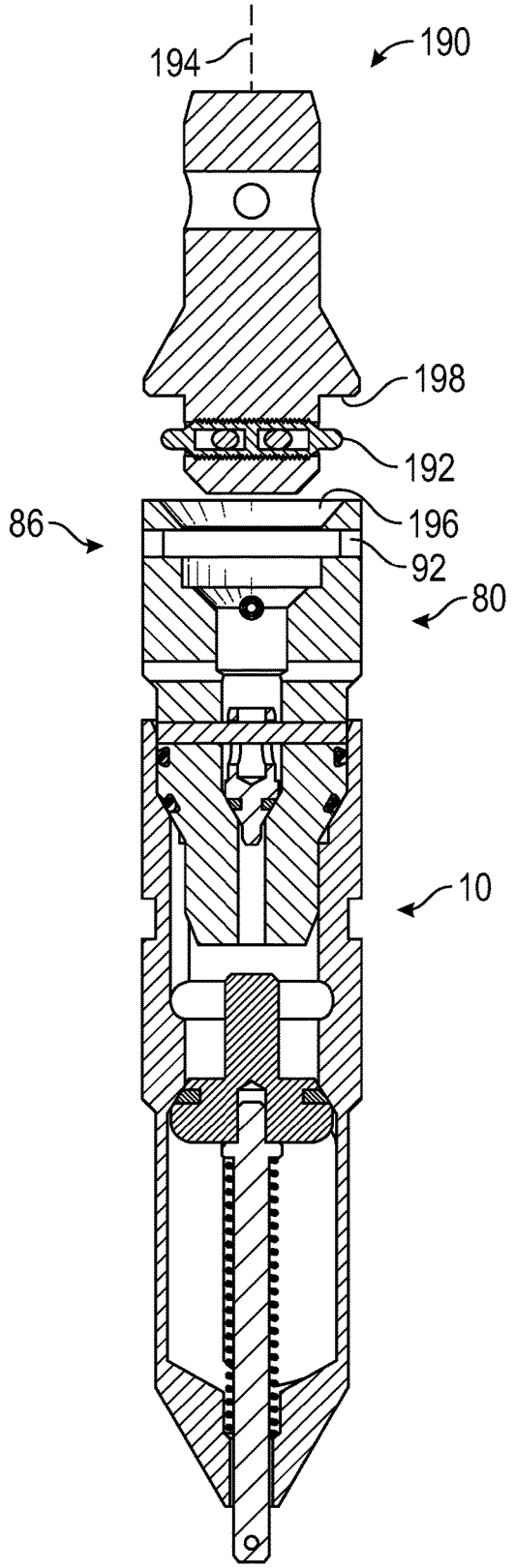
FIG. 7B is a schematic side view of an embodiment of the test dart of FIG. 7A coupled to the unidirectional valve of FIG. 7A positioned proximate a removal tool, in accordance with embodiments of the present disclosure.
Figure 7C:
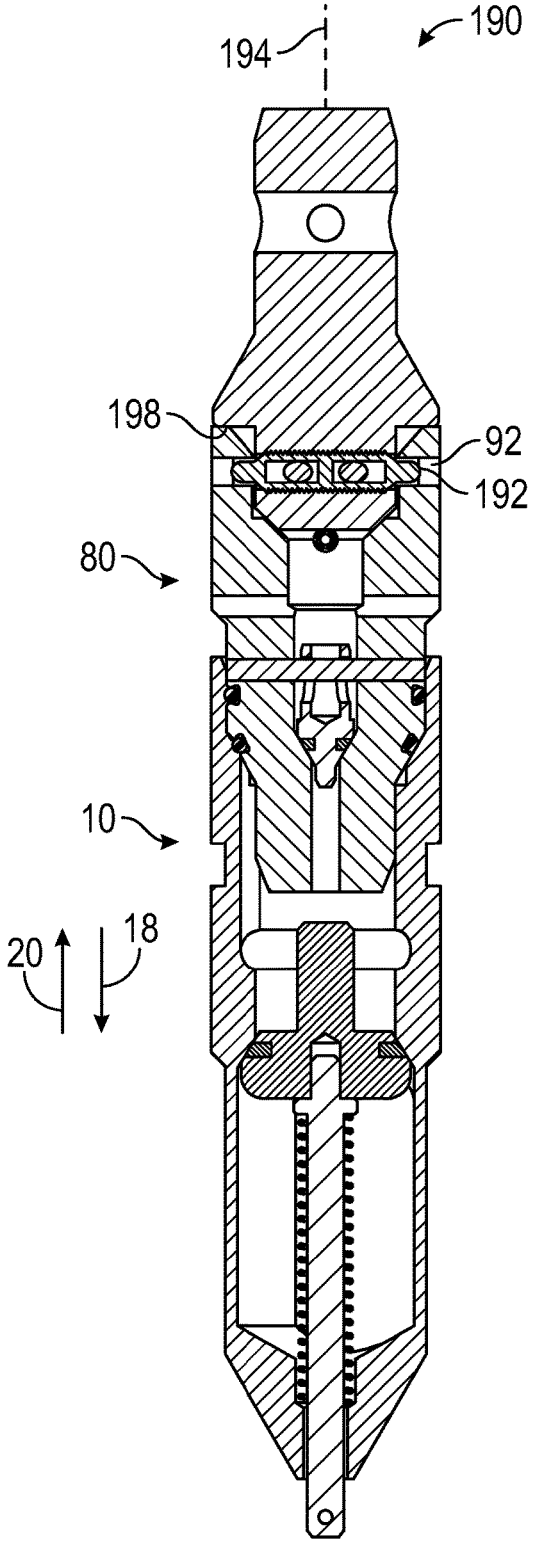
FIG. 7C is a schematic side view of an embodiment of the test dart of FIG. 7A coupled to the unidirectional valve of FIG. 7A and the removal tool of FIG. 7A, in accordance with embodiments of the present disclosure.
Figure 7D:
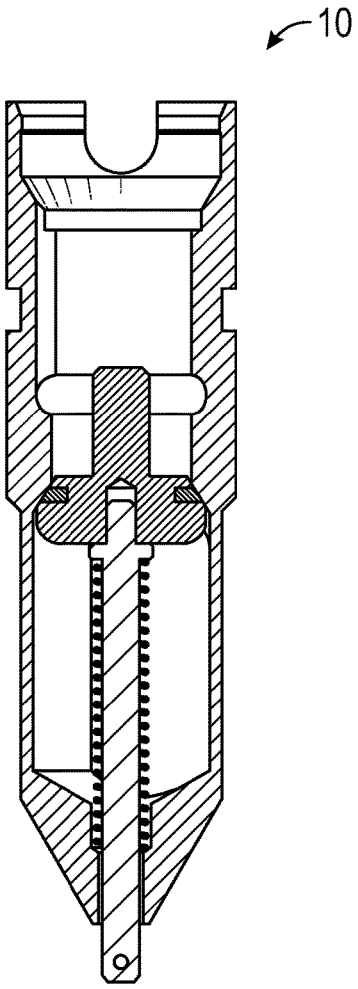
FIG. 7D is a schematic diagram of the unidirectional valve of FIG. 7A, in accordance with embodiments of the present disclosure.

FIG. 7C illustrates the removal tool 190 coupled to the test dart 80. As shown, the plungers 192 are biased outwardly from the axis 194 upon alignment with the groove 92 formed in the test dart 80. The size of the groove 92 may be particularly selected to receive the plungers 192. Furthermore, the groove 92 may further be sized such that the groove 92 is deeper than the plungers 192. Accordingly, rotational forces applied to the removal tool 190 will not be transmitted to the test dart 80 and rather the plungers 192 will rotate about the axis 194 within the groove 92. As such, the removal tool 190 is coupled to the test dart 80 and may transmit a linear force in the upstream direction 20 to unseat the test dart 80 from the unidirectional valve 10. In other words, a pulling force is utilized to removal the test dart 80, as opposed to a rotational force. Accordingly, the likelihood of unseating the unidirectional valve 10 from the hanger 14 may be reduced. In the embodiment illustrated in FIG. 7C, the removal tool 190 includes a downward facing shoulder 198 that contacts the test dart 80 when the removal tool 190 is coupled to the test dart 80. The downward facing shoulder 198 may block further movement of the removal tool 190 in the downstream direction 18 and serve as an indicator that the removal tool 190 is coupled to the test dart 80. However, it should be appreciated that in other embodiments the downward facing shoulder 198 may not be utilized. FIG. 7D illustrates the unidirectional valve 10 arranged in the wellbore after the test dart 80 is removed. It should be appreciated that a dry rod may be used to remove the test dart 80. In other words, the test dart 80 may be removed in a non-controlled environment, thereby facilitating faster and less expensive removal of the test dart 80.

Figure 8:
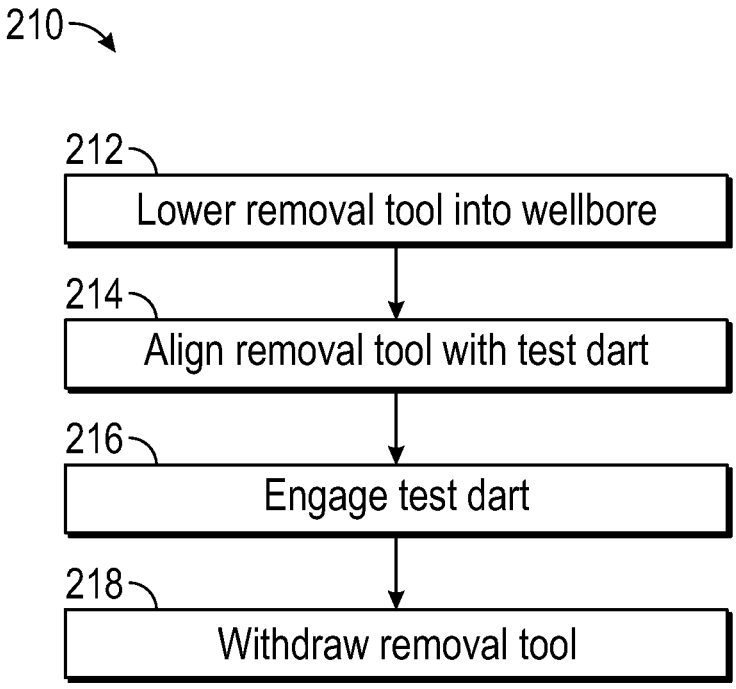
FIG. 8 is a flow chart of an embodiment of a method for removing a test dart from a wellbore, in accordance with embodiments of the present disclosure.

FIG. 8 is a flow chart of an embodiment of a method 210 for removing the test dart 80 from the wellbore. In certain embodiments, removal may be facilitated utilizing a dry rod in a non-controlled environment. However, it should be appreciated that a controlled environment may also be used, for example with a lubricator. The removal tool 190 is lowered into the wellbore (block 212). For example, the dry rod may be used to install the removal tool 190. The removal tool 190 is aligned with the test dart 80 (block 214). In certain embodiments, the removal tool axis 194 is substantially coaxial with the dart axis 112 before removal. As such, the removal tool 190 may be inserted into the bore 84. Next, the removal tool 190 engages the test dart 80 (block 216). It should be appreciated that the size of the removal tool 190 may be particularly selected such that the removal tool 190 is capable of engaging the test dart 80 without having movement blocked by the lock out pin 98. Engagement is facilitated by the plungers 192 extending into the groove 92 of the test dart 80 to thereby secure the removal tool 190 to the test dart 80. Thereafter, the removal tool 190 is withdrawn from the wellbore (block 218). For example, a linear force may be applied to the removal tool 190 in the upstream direction 20. As the removal tool 190 is drawn upstream, the plungers 192 catch the test dart 80 and transmit the linear force to the test dart 80 for removal from the wellbore. In this manner, upstream pressure testing may be completed and subsequent wellbore operations may commence.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

The invention claimed is:

1. A test dart for wellbore pressure isolation, comprising:

a body extending from a first end to a second end, the body having a bore extending therethrough, a diameter of the bore being greater at the first end than the second end;

a groove formed proximate the first end and extending radially outward from the bore and into the body;

an anti-rotation pin positioned between the groove and the second end, the anti-rotation pin extending radially outward from the body;

a check valve positioned in the bore, the check valve enabling a flow in a single direction and being moveable between an open position to enable the flow and a closed position to block the flow; and a pressure relieving orifice in the bore extending radially outwardly into the body.

2. The test dart of claim 1, further comprising:

a counter bore positioned axially below the groove;

a slanted edge forming a transition between a change in the diameter of the bore; and a lock out pin positioned proximate the counter bore, the lock out pin moveable between an extended position and a retracted position such that the lock out pin at least partially extends into the bore when in the extended position.

3. The test dart of claim 2, wherein the lock out pin is a spring loaded pin accessible from an outer diameter of the body via a notch formed in the body.

4. The test dart of claim 1, wherein the pressure relieving orifice is a weep hole, the weep hole extending radially outward from the diameter of the bore and into the body.

5. The test dart of claim 1, further comprising a profile arranged between the anti-rotation pin and the second end, the profile having a downwardly slanted edge along an outer diameter of the body.

6. The test dart of claim 5, further comprising a seal annulus on the profile for retaining a seal.

7. The test dart of claim 1, wherein an outer diameter of the test dart decreases from the first end to the second end.

8. The test dart of claim 1, further comprising threads arranged in at least a portion of the bore.

9. The test dart of claim 1, further comprising a tapered shoulder at the first end, the tapered shoulder extending downwardly and inwardly and being arranged axially above the groove.

10. A system for isolating regions of a wellbore, the system comprising:

a unidirectional valve positioned in the wellbore, the unidirectional valve permitting a fluid flow in a downstream direction into the wellbore and restricting the fluid flow in an upstream direction out of the wellbore;

a test dart non-rotationally coupled to the unidirectional valve via a gravitational force acting on the test dart, the test dart arranged upstream of the unidirectional valve and positioned to block the fluid flow in the downstream direction toward the unidirectional valve; and a removal tool, the removal tool non-rotationally coupling to the test dart and positioned to remove the test dart in a non-controlled wellbore environment via a linear force.

11. The system of claim 10, wherein the test dart comprises anti-rotation pins that align with u-slots formed in the unidirectional valve, the anti-rotation pins blocking transmission of rotational forces applied to the test dart from acting on the unidirectional valve.

12. The system of claim 10, further comprising an installation tool coupled to the test dart during installation procedures, the installation tool being rotationally coupled to the test dart and positioned to install the test dart in a non-controlled wellbore environment, and the installation tool extending into a bore of the test dart when a lock out pin formed in the test dart is transitioned to a retracted position out of the bore.

13. The system of claim 10, wherein the removal tool couples to the test dart via one or more plungers extending into a groove formed in the test dart.

14. The system of claim 10, wherein a metal-to-metal seal is formed at a coupling between the test dart and the unidirectional valve.

15. The system of claim 10, wherein the test dart comprises a check valve and a weep hole arranged proximate the check valve, the weep hole providing a flow path for pressurized fluids positioned between the test dart and the unidirectional valve in the upstream direction.

16. A method for isolating a wellbore, the method comprising:

lowering a test dart into the wellbore, the test dart being coupled to an installation tool;

non-rotationally coupling the test dart to a unidirectional valve arranged in the wellbore via a gravitational force acting on the test dart;

decoupling the installation tool from the test dart;

lowering a removal tool into the wellbore to retrieve the test dart;

non-rotationally coupling the removal tool to the test dart; and withdrawing the test dart from the wellbore.

17. The method of claim 16, wherein the step of lowering the test dart into the wellbore is done in a non-controlled wellbore environment.

18. The method of claim 16, wherein the step of coupling the test dart to the unidirectional valve comprises aligning an anti-rotation pin coupled to the test dart with a u-slot formed in the unidirectional valve.

* * * * *